US008398377B2

(12) United States Patent
Itabashi et al.

(10) Patent No.: US 8,398,377 B2
(45) Date of Patent: Mar. 19, 2013

(54) ELECTRIC COMPRESSOR WITH INTEGRAL INVERTER

(75) Inventors: Takaaki Itabashi, Isesaki (JP); Masahiko Osaka, Ohta (JP); Kou Tsukamoto, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 302 days.

(21) Appl. No.: 12/528,297

(22) PCT Filed: Feb. 13, 2008

(86) PCT No.: PCT/JP2008/052342

§ 371 (c)(1),
(2), (4) Date: Mar. 5, 2010

(87) PCT Pub. No.: WO2008/102676

PCT Pub. Date: Aug. 28, 2008

(65) Prior Publication Data

US 2010/0183458 A1 Jul. 22, 2010

(30) Foreign Application Priority Data

Feb. 22, 2007 (JP) ..... 2007-042161

(51) Int. Cl.
*F04B 49/06* (2006.01)

(52) U.S. Cl. ..... 417/44.1; 417/410.1; 417/410.5; 310/43; 310/89

(58) Field of Classification Search ..... 417/410.1, 417/410.5, 44.1; 310/43, 89, 88, 87, 68 R, 310/51

See application file for complete search history.

(56) References Cited

U.S. PATENT DOCUMENTS

| | | | | |
|---|---|---|---|---|
| 6,599,104 | B2 * | 7/2003 | Saito et al. | 417/366 |
| 6,619,933 | B2 * | 9/2003 | Ikeda | 417/410.1 |
| 6,844,651 | B1 * | 1/2005 | Swift et al. | 310/214 |
| 7,067,944 | B2 * | 6/2006 | Lieu et al. | 310/43 |
| 7,096,566 | B2 * | 8/2006 | Du et al. | 29/596 |
| 2006/0138886 | A1 * | 6/2006 | Ito et al. | 310/89 |
| 2010/0143165 | A1 * | 6/2010 | Itabashi et al. | 417/366 |

FOREIGN PATENT DOCUMENTS

| | | | |
|---|---|---|---|
| JP | S59-050534 | A | 3/1984 |
| JP | H04-080554 | A | 3/1992 |
| JP | H04-340258 | A | 11/1992 |
| JP | 2005-101291 | A | 4/2005 |

* cited by examiner

*Primary Examiner* — Devon Kramer
*Assistant Examiner* — Joseph Herrmann
(74) *Attorney, Agent, or Firm* — Baker Botts L.L.P.

(57) ABSTRACT

An electric compressor provided with an integral inverter, incorporated with a motor and provided in a receiving space surrounded by a compressor housing with a motor drive circuit that includes the inverter. At least some of electric parts including the motor drive circuit are covered by a resin charged into the receiving space, and a part of a region which is in the receiving space and into which the resin can be charged is filled with a light-weight material different from the charged resin. In the structure of the resin covering section for such a motor drive circuit, the amount of resin charged is significantly reduced, and the entire compressor is reduced in weight and cost.

9 Claims, 1 Drawing Sheet

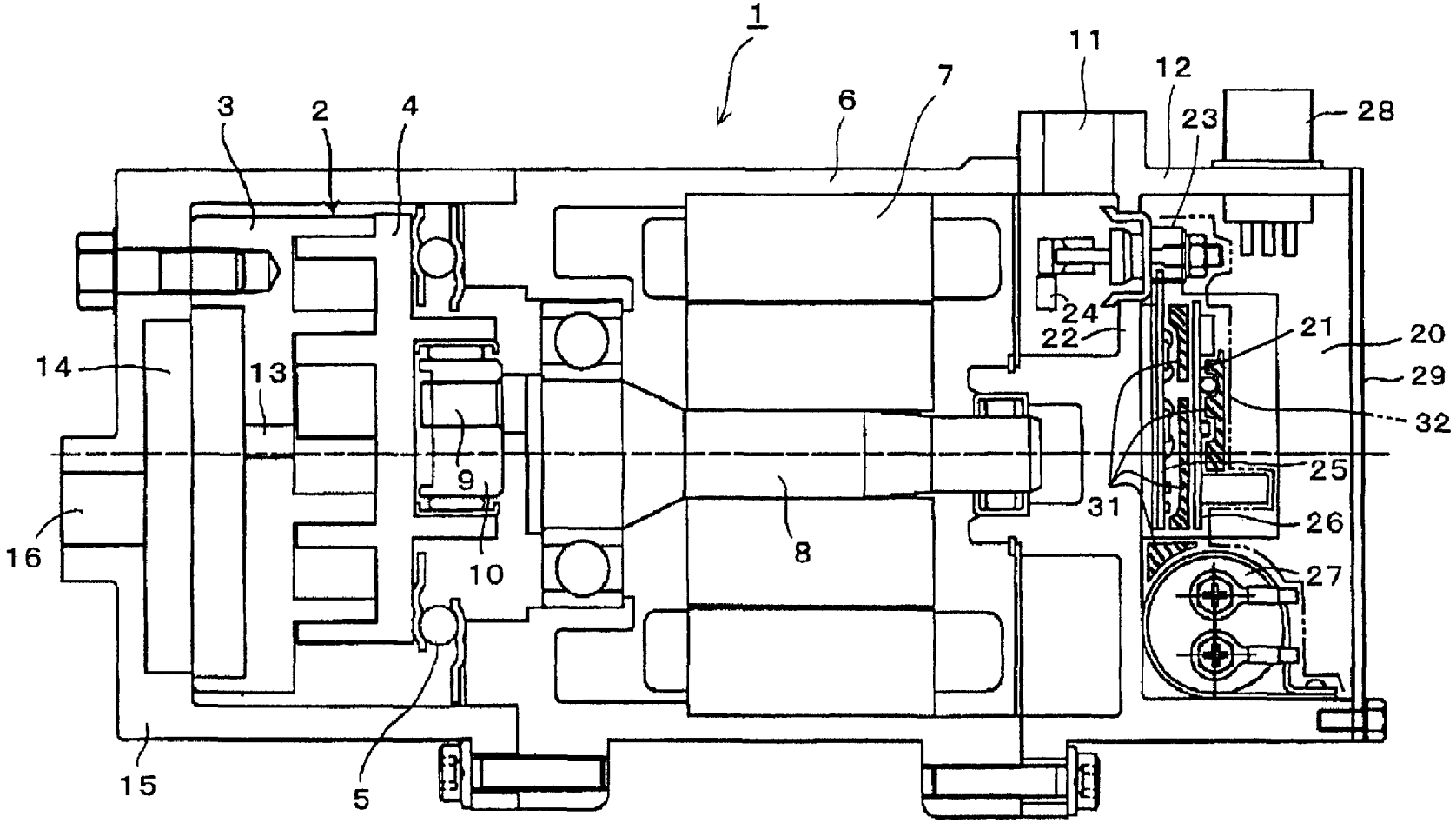
1
2
3
4
5
6
7
8
9
10
11
12
13
14
15
16
20
21
22
23
24
25
26
27
28
29
31
32

ELECTRIC COMPRESSOR WITH INTEGRAL INVERTER

CROSS-REFERENCE TO RELATED APPLICATIONS

This application is the National Stage of International Patent Application No. PCT/JP2008/052342, filed Feb. 13, 2008, which claims the benefit of Japanese Patent Application No. 2007-042161, filed Feb. 22, 2007, the disclosures of which are incorporated herein by reference in their entirety.

TECHNICAL FIELD OF THE INVENTION

The present invention relates to an electric compressor with an integral inverter, incorporated in a compressor with a motor drive circuit that includes the inverter, and specifically relates to an electric compressor with an integral inverter which can be reduced in weight and cost as a whole compressor by reducing the weight of a resin charged section when resin is charged in order to insulate and protect the motor drive circuit.

BACKGROUND ART OF THE INVENTION

In a known structure of an electric compressor incorporated with a motor drive circuit including an inverter, etc., a motor drive circuit is coated by a resin mold material for insulation so as to be buried in the resin mold material. (e.g. patent document 1)

Further, in another known structure, a power semiconductor module located between a lid and a compressor housing (at the low pressure side in the housing) is coated and buried by pouring a insulating synthetic resin which has been heated to be fluidized. (e.g. patent document 2) In the structure described in patent document 2, a whole chamber containing electric parts such as a power semiconductor module, etc. is filled with a resin mold material.

Patent document 1: JP-2002-70743

Patent document 2: JP-4-80554

DISCLOSURE OF THE INVENTION

Problems to be Solved by the Invention

However, in the above-described conventional structure, because the motor drive circuit, etc. is completely buried by charging with the resin into substantively wholly the chamber containing the motor drive circuit, etc., the amount of the charged resin or resin usage increases, so that it becomes difficult to reduce the cost and weight as a whole electric compressor. And especially for an electric compressor used in an air conditioning system for vehicles, it is needed to reduce the cost and weight as far as possible.

According to such problems and needs in conventional electric compressors, an object of the present invention is to provide an electric compressor with an integral inverter incorporated with a motor, in which the charged resin amount, for the structure of the resin coated section in the motor drive circuit, etc. can be greatly reduced to make a whole compressor cost-cut and lightweight.

Means for Solving the Problems

To solve the above-described object, an electric compressor with an integral inverter according to the present invention is a compressor, incorporated with a motor and provided in a receiving space surrounded by a compressor housing with a motor drive circuit that includes the inverter, characterized in that at least some of electric parts including the motor drive circuit are covered by a resin charged into the receiving space, and a part of a region which is in the receiving space and into which the resin can be charged is filled with a light-weight material (void material) different from the charged resin.

In the conventional structure as described above, the resin is charged substantially all over the chamber which receives the motor drive circuit, etc. so that the amount of charged resin becomes inevitably great. However, in a structure of the present invention, because a part of a region into which the resin can be charged is filled with a material different from the charged resin, the amount of the charged resin can be reduced by at least the amount of volume in which the different material is filled, so that the resin-covered section, and even the whole compressor, can be reduced in weight and cost.

Specifically, in a case that the material different from the charged resin is a material whose density or bulk density is lower than the charged resin, the weight can be surely reduced. From a point of view of reduction in cost and weight, the region into which the resin can be charged with is desired to be essentially minimized. However, even if the region into which can be charged with the resin is like a conventional one, the weight of the region in which the resin can be charged is reduced by filling a part of the region with the material whose density or bulk density is lower than the charged resin.

For a different material (void material), various kinds of material can be used as long as the density or bulk density of the material is lower than the charged resin. For example, the material different from the charged resin can be a preformed resin part with a low density, or an assembly of synthetic fibers with a low bulk density such as nylon or polyester fibers. When the different material is the resin part its shape can be preformed in a shape responding to the void which should be filled. And when the different material is the assembly of synthetic fibers it can be stuffed into the void which should be filled. In other words, the void which has been conventionally filled with the charged resin can be filled with a different material whose density or bulk density is lower than the charged resin. As the preformed resin part with a low density, a foaming body such as polystyrene can be used.

In the compressor with an integral inverter of the present invention, specifically when refrigerant is used as a fluid to be compressed, at least some of electric parts including the motor drive circuit are mounted in the receiving space so as to enable heat exchange with suction refrigerant as a compressed fluid. For example, it is preferred that the motor drive circuit is mounted in or near a compressor housing located at a suction path for refrigerant, so as to enable heat exchange there. Being thus constructed, the inverter which tends to overheat can be properly cooled automatically, so as to maintain a predetermined performance of the motor drive circuit, and the structure can be simplified because a cooling device is not required to provide separately.

Further, it is preferable that the resin is charged after the different material is mounted in the receiving space. Namely, the resin-charging is to be performed in a condition where content parts of the receiving space have been all mounted in a predetermined position. Whereby, it becomes possible that the resin is easily charged and even that the different material located at a predetermined position takes a part of holding fixation role of the electric part during holding and fixing each electric part to a predetermined position. Further, use of a liquid resin material can make it possible to spread a poured resin all over the essential region in the receiving space easily and quickly, and to much more simplify the resin-charging work. When this liquid resin material is used, the liquid resin material can be poured into the region to be charged with the resin and cover an essential target site properly by coating, etc. in a progression process of the pouring.

Further, in the present invention it is also preferred that the resin-charging is performed under a residual heat condition after heating of at least some of electric parts including the motor drive circuit. Because in this case the resin material is made well fluidized responding to a residual heat, this method can be adopted, when it is required to perform a sufficient resin-charging even in a minimal space of the region to be charged with the resin.

A thermosetting resin such as urethane and epoxy is preferable used as a resin material for the resin-charging. Even if the inverter, etc. becomes hot to some extent, a thermosetting resin would maintain a sufficient high heat resistance and durability, after hardened properly.

The electric compressor with an integral inverter having the resin-charging structure according to the present invention is specifically suitable for a compressor used in an air conditioning system for vehicles which strongly requires the reduction in cost and weight as a whole compressor.

Effect According to the Invention

In the electric compressor with an integral inverter according to the present invention, because a partial void of a region into which the resin can be charged is filled with a material different from the charged resin, the charged resin can be reduced at least by the volume filled with the different material, so that the resin covered section and even the whole compressor can be reduced in weight and cost.

BRIEF EXPLANATION OF THE DRAWINGS

FIG. 1 is a schematic vertical sectional view of the electric compressor with an integral inverter according to an embodiment of this invention.

EXPLANATION OF SYMBOLS

1: electric compressor with integral inverter
2: compression mechanism
3: fixed scroll
4: movable scroll
5: ball coupling
6: compressor housing (center housing)
7: motor
8: main shaft
9: eccentric pins
10: eccentric bush
11: suction port
12: compressor housing (front housing)
13: discharge pore
14: discharge chamber
15: compressor housing (rear housing)
16: discharge port
20: receiving space
21: motor drive circuit
22: partition wall
23: seal terminal
24: lead wire
25: IPM
26: control circuit
27: capacitor
28: connector
29: lid member
31: different material
32: charged resin

THE BEST MODE FOR CARRYING OUT THE INVENTION

Hereinafter, desirable embodiments of the present invention will be explained referring to figures.

FIG. 1 shows electric compressor with an integral inverter 1 according to an embodiment of the present invention, and specifically shows an example of the present invention applying to a scroll type electric compressor. In FIG. 1, symbol 2 shows a compression mechanism consisting of fixed scroll 3 and movable scroll 4. Movable scroll 4 is swung to fixed scroll 3 in a condition that a rotation is prevented through ball coupling 5. Motor 7 is incorporated in compressor housing 6 (center housing) and rotates main shaft 8 (rotation axis). Rotational movement of main shaft 8 is transformed to an orbital movement of movable scroll 4, through eccentric pin 9 provided at one end of main shaft 8 and eccentric bush 10 which is engaged rotatably with it. In this embodiment, suction port 11 sucking a refrigerant as a fluid to be compressed is provided in compressor housing 12 (front housing), and the sucked refrigerant is led to compression mechanism 2 through a section placing motor 7, and the refrigerant which has been compressed by compression mechanism 2 is delivered to an external circuit through discharge pore 13, discharge chamber 14, and discharge port 16 which is provided in compressor housing 15 (rear housing).

Receiving space 20 is formed being circumscribed by an extended section of compressor housing 12 (front housing) and motor drive circuit 21 is provided in receiving space 20. Specifically, motor drive circuit 21 is provided at the exterior side of partition wall 22 which is formed in compressor housing 12 separating from the side of the refrigerant suction path. Motor drive circuit 21 supplies electric power to motor 7 via lead wire 24, and via seal terminal 23 (output terminal of motor drive circuit 21) attached by penetrating through partition wall 22, and the side of refrigerant suction path and the side of a section placing motor drive circuit 21 are sealed at a section placing seal terminal 23. By providing motor drive circuit 21 at an exterior side of partition wall 22, at least some of electric parts including motor drive circuit 21 can exchange heat through partition wall 22 with suction refrigerant, so as to be cooled by suction refrigerant.

Motor drive circuit 21 includes IPM 25 (Intelligent Power Module) which can perform an inverter function and control circuit 26, and electric parts such as capacitor 27, etc. are provided with it separately or integrally. Motor drive circuit 21 is connected to an external power supply (not shown) through connector 28 as an input terminal. The opening side toward the outside of compressor housing 12 where electric parts including motor drive circuit 21 are mounted is covered in a state being sealed with lid member 29, and these electric parts are protected by lid member 29.

Together with the electric parts such as motor drive circuit 21 and capacitor 27, etc. different material 31 which is different from the charged resin and which is formed either in a shape filling a void among the electric parts or in a shape to cover the circuit placing the electric parts partially, is mounted in a predetermined site. In this way, after different material 31 is placed in receiving space 20 together with the electric parts, those as substantively the whole are to be covered with charged resin 32 by resin-charging. In this state, a part of the resin chargeable region is to be filled up with different material 31. By configuring different material 31 by a material whose density or bulk density is lower than charged resin 32, the region into which the resin can be charged can be surely reduced in weight in comparison with a case that the charged resin is filled up wholly, so that the cost can be also reduced by the reduction of the amount of the resin usage.

If the resin is charged into receiving space 20 at the essentially minimum range as shown in the FIGURE, the weight can be much more reduced in comparison with a case that the resin is charged up wholly in receiving space 20. This resin-charging at the essentially minimum range can be performed by coating with a liquid resin material, for example. Further, because different material 31 has been already mounted at a predetermined position at the time of this resin-charging, the resin can be charged with in a condition that each electric part is held by each different material 31, so as to simplify a desirable resin-charging.

After the resin-charging is completed, lid member 29 can be mounted. Further, the electric parts, etc. can be also charged with the resin under a residual heat condition after preheating as described above. Such configuration can make the resin material fluidized better responding to the residual heat, so as to charge with the resin sufficiently even into a minimal space in a region to be charged with resin.

INDUSTRIAL APPLICATIONS OF THE INVENTION

The structure of the resin charging section using different material structure according to the present invention can be applied to a general compressor with an integral inverter, and is specifically suitable to a compressor used in an air conditioning system for vehicles which strongly requires lightweight and cost reduction as a whole compressor.

The invention claimed is:

1. An electric compressor comprising:

a compressor housing comprising a receiving space;

a motor;

an integral inverter, incorporated with the motor and provided in said receiving space surrounded by the compressor housing with a motor drive circuit that comprises said integral inverter;

at least some electric parts comprising said motor drive circuit, a capacitor, and said integral inverter are covered by a resin charged into said receiving space, and a plurality of preformed resin parts occupy a part of a region, which is in said receiving space and into which said resin is charged; and said plurality of preformed resin parts are formed of a material different from said charged resin and said at least some electric parts;

wherein each preformed resin part of said plurality of preformed resin parts has a shape complementary to at least one electric part in order to be mounted at a predetermined site in said receiving space, and wherein each of said plurality of preformed resin parts is located between said at least one electric part and said charged resin to hold said at least some electric parts, and wherein said material different from said charged resin is a material the density or bulk density of which is less than that of said charged resin.

2. The electric compressor with said integral inverter according to claim 1, wherein each preformed resin part is made of a foamed body.

3. The electric compressor with said integral inverter according to claim 1, wherein said material different from said charged resin is an assembly of synthetic fibers.

4. The electric compressor with said integral inverter according to claim 1, wherein said at least some electric parts comprising said motor drive are provided in said receiving space and proximate to a refrigerant suction path, so as to enable heat exchange with refrigerant sucked as fluid to be compressed.

5. The electric compressor with said integral inverter according to claim 1, wherein said resin charging is performed after said material different from said charged resin has been incorporated in said receiving space with said at least some electric parts.

6. The electric compressor with said integral inverter according to claim 1, wherein said charged resin is a thermosetting resin.

7. An air conditioning system for vehicles comprising the electric compressor with the integral inverter according to claim 1.

8. A method for manufacturing an electric compressor installing a motor, an integral inverter, and a motor drive circuit in a receiving space provided in a compressor housing adjacent to a motor housing portion;

forming a charging space between at least some electric parts of said motor drive circuit and a material structure having a shape complementary to said at least some electric parts;

charging a liquid resin material into at least said charging space of said receiving space, wherein said material structure is formed from a material different from said charged liquid resin and said different material is a material the density or bulk density of which is less than that of said charged liquid resin; and coating said at least some electric parts comprising said motor drive circuit are coated with said liquid resin charged into at least said charging space of said receiving space, wherein said material structure is formed in a shape to hold said at least some electric parts prior to said resin charging.

9. The method for manufacturing the electric compressor with said integral inverter according to claim 8, heating said at least some electric parts including said motor drive circuit; and performing the resin charging under a residual heat condition after heating of said at least some of electric parts including said motor drive circuit.

* * * * *